United States Patent [19]

Dominique

[11] 4,209,105

[45] Jun. 24, 1980

[54] FOLLOWER PLATE WIPER

[75] Inventor: Cecil G. Dominique, Bryan, Ohio

[73] Assignee: The Aro Corporation, Bryan, Ohio

[21] Appl. No.: 868,501

[22] Filed: Jan. 11, 1978

[51] Int. Cl.[2] ..... B65D 53/02

[52] U.S. Cl. ..... 220/93; 220/222; 277/206 R

[58] Field of Search ..... 277/206 R, 212 R, 212 F, 277/212 C; 222/386, 386.5; 92/242, 243, 193, 194, 257; 220/93, 222, 378

[56] References Cited

U.S. PATENT DOCUMENTS

| | | | |
|---|---|---|---|
| 876,853 | 1/1908 | Wille | 92/257 |
| 1,121,057 | 12/1914 | Willcox et al. | 220/222 |
| 1,465,540 | 2/1922 | Morris | 92/257 X |
| 2,019,757 | 11/1935 | Loweke | 277/206 X |
| 2,293,564 | 8/1942 | Schnell | 277/206 X |
| 2,719,768 | 10/1955 | Webber | 92/242 |
| 2,768,661 | 10/1956 | Tyler | 222/386 X |
| 2,778,695 | 1/1957 | Sturtevant | 277/206 X |
| 2,783,106 | 2/1957 | Barnhart | 277/206 X |
| 2,801,140 | 7/1957 | Kretzer | 92/244 |
| 3,164,289 | 1/1965 | Cocchiarella | 220/93 |
| 3,314,683 | 4/1967 | Schmidt et al. | 277/206 X |
| 3,319,329 | 5/1967 | Knutsen et al. | 220/220 X |
| 3,439,829 | 4/1969 | Thompson et al. | 220/222 |
| 3,563,557 | 2/1971 | Doutt | 277/206 R X |
| 3,578,467 | 5/1971 | Huber | 220/93 X |
| 3,781,942 | 1/1974 | Coleman | 220/93 X |

FOREIGN PATENT DOCUMENTS

| | | | |
|---|---|---|---|
| 672062 | 12/1929 | France | 222/386 |
| 460407 | 1/1937 | United Kingdom | 277/206 |

*Primary Examiner*—Allan N. Shoap

*Attorney, Agent, or Firm*—Allegretti, Newitt, Witcoff & McAndrews

[57] ABSTRACT

A follower plate assembly for industrial drums includes an improved lip seal construction. The follower plate assembly has a projecting ledge to support a circumferential seal. The seal has a U-shaped cross section. The legs of the seal project radially into engagement with the container wall. The crown of the seal engages the follower plate. The ledge prevents axial movement of the seal. A circumferential band in combination with a ring or locking pins retain the seal on the follower plate.

4 Claims, 9 Drawing Figures

FOLLOWER PLATE WIPER

BACKGROUND OF THE INVENTION

This invention relates to an improved follower plate assembly and, more particularly, to the circumferential seal for a follower plate assembly.

To remove fluid materials from containers such as barrels, a common technique is to utilize a mechanical pump in combination with a follower plate assembly. The follower plate fits within the end of the barrel and "follows" the fluid level in the barrel as fluid is withdrawn by means of the pump.

Generally, the follower plate coincides with the shape of the barrel and includes circumferential seals which engage the interior side walls of the barrel. In this manner, movement of the follower plate downward into the barrel may assist in the pumping operation and also provides a means for separating the fluid being pumped from contamination by the atmosphere. In the past, various follower plate designs have been proposed. A typical prior art design is disclosed by FIGS. 1 and 2. With such a design, the circumferential seal for the follower plate comprises one or more hoses which are banded or clamped onto the follower plate. The hoses are made from a rubber material and act as "O ring" seals.

Generally, the banded O ring, hose construction includes a casting or follower with two diametral grooves around the outside diameter of the casting. Two hoses are wrapped around the follower plate and retained in the grooves with metal strapping typically of the type used to band boxes and crates.

This banded hose construction is difficult to make and assemble. The hoses must be cut precisely the right length in order to completely encircle the follower in the associated diametral groove. The hoses must butt together at the ends without leaving a gap. On the other hand, they must not butt too tightly in order to avoid buckling of the hose. The hoses must be retained on the casting by placement of strapping inside of the hose so that the strapping will not scrape on the container wall. Assembly of such a hose construction is difficult. When the seals of such a follower plate assembly do become warn, replacement is complex and time consuming, often requiring complete disassembly of the follower plate.

An alternative to the described construction requires utilization of very large O-ring members. Such O-ring members are made from an elastomeric material and are usually solid. They have limited resiliency. In practice, such O-rings tend to roll out of a follower plate groove. The present invention seeks to overcome these and other problems associated with prior art assemblies.

SUMMARY OF THE INVENTION

In a principal aspect, the present invention comprises a follower plate with a single integral follower seal attached to the plate and retained thereon by means of a strap or band. The follower seal is generally U-shaped or cross section with lips extending radially toward the container walls from the crown portion. Alternative means are shown for retention of the follower seal on the follower plate.

Thus, it is an object of the present invention to provide an improved follower plate seal construction.

Another object of the present invention is to provide an improved follower plate seal construction which may be easily removed and replaced on the follower plate assembly.

Still another object of the present invention is to provide a seal construction for a follower plate assembly which accommodates variations and discrepancies in the shape and condition of the interior side wall of a container.

A further object of the present invention is to provide a follower seal in combination with means for retaining the seal on a follower plate wherein the seal has a novel structure.

One further object of the present invention is to provide a seal construction for a follower plate assembly which can be easily removed, replaced and assembled.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENTS

Figure 1:
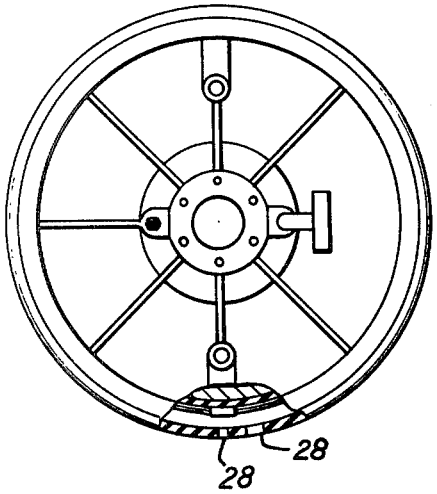
PRIOR ART Fig. 1
FIG. 1 is a top plan view of a typical prior art follower plate assembly.
Figure 2:
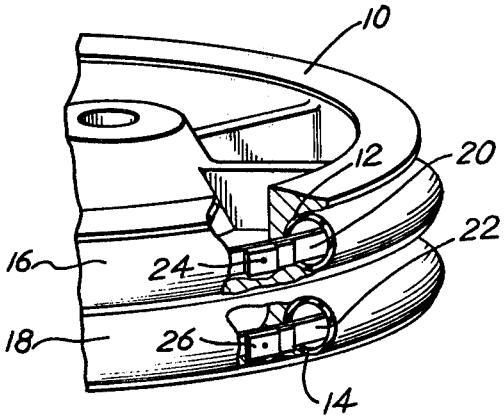
PRIOR ART Fig. 2
FIG. 2 is a perspective view of the assembly shown in FIG. 1.

FIGS. 1 and 2 illustrate a typical prior art follower plate structure. Referring to these figures, a follower plate 10 includes first and second diametral grooves 12 and 14 which are cast into the circumferential edge of the plate 10. First and second hoses 16 and 18 made from an elastomeric material are cut to a proper length to fit into grooves 12 and 14 respectively. The hoses 16 and 18 are retained in position in their associated grooves 12 and 14 by means of metal bands or straps 20 and 22 respectively which are positioned inside of the hoses 16 and 18. The ends of the respective straps 20 and 22 are fastened by means of clamps 24 and 26 respectively and are attached by projecting appropriate tools through openings as at 28 in FIG. 1 in the hoses 16 and 18.

Figure 3:
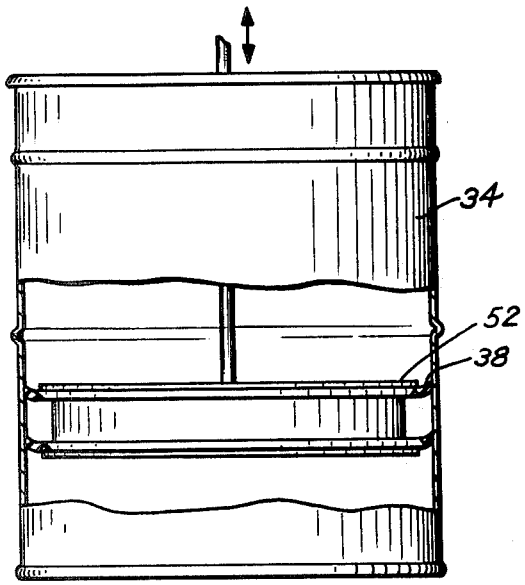
FIG. 3 is a cut-away cross-sectional view of a typical container in which the improved follower plate assembly of the present invention has been positioned.
Figure 4:
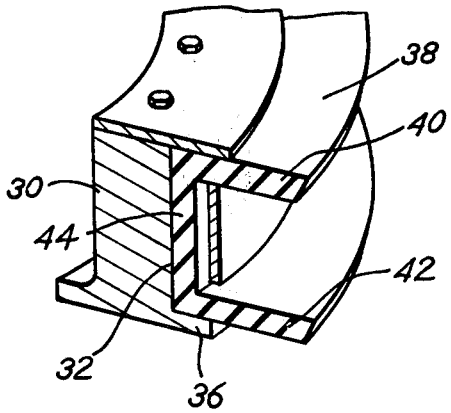
FIG. 4 is a perspective cross-sectional view of the improved follower plate assembly of the present invention.
Figure 5:
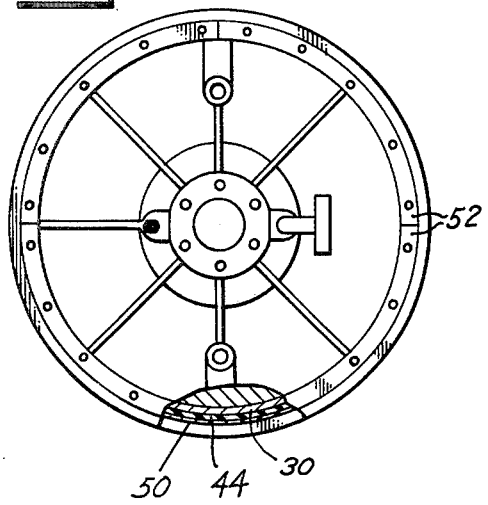
FIG. 5 is a top plan view of the improved assembly of the invention.
Figure 6:
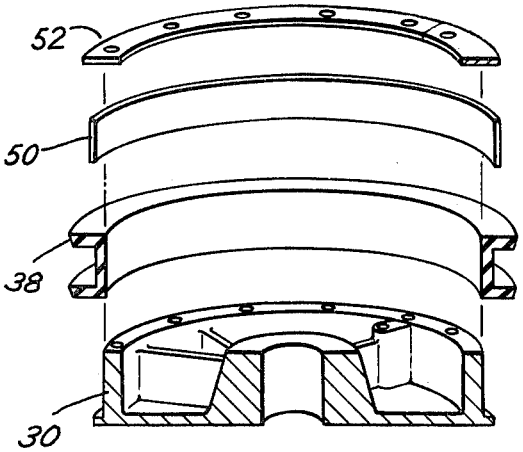
FIG. 6 is an exploded cross-sectional view of the improved assembly of the present invention.
Figure 7:
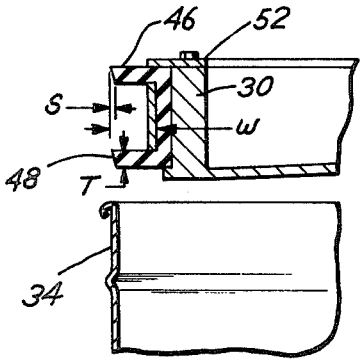
FIG. 7 is a partial side section of the improved assembly of the present invention prior to insertion into a container.
Figure 8:
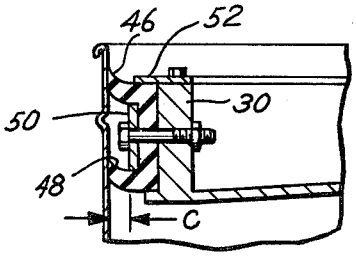
FIG. 8 is a side cross section view similar to FIG. 7 wherein the follower plate assembly has been inserted into an associated container.

The prior art structure disclosed in FIGS. 1 and 2 works in a satisfactory manner but exhibits the disadvantages and characteristics described previously. The improvement of the present invention is disclosed by the remaining FIGS. 3–9. Referring first to FIG. 4, the improvement of the present invention includes a follower plate 30 which may be cast or formed by a drawing process. The plate 30 includes a transverse surface 32 generally parallel to the axis of travel of the follower plate 30 in a drum 34 as shown in FIG. 3. A radially projecting ledge 36 extends from the surface 32 outward toward the walls of the drum 34 as shown in FIG. 3.

A follower seal 38 slips or fits over the plate 32. The seal 38 is fashioned from an elastomeric material. Preferably, the seal 38 has a U-shaped cross section including first and second radially extending lips 40 and 42 connected by a crown 44. The lips 40 and 42 and the crown 44 are of generally uniform thickness. This thickness is designated by the letter T in FIG. 7. Each lip 40 and 42 includes an outwardly facing circumferential end surface 46 and 48 respectively. The end surfaces 46 and 48 are inclined downwardly and inwardly toward the axis of movement of the follower plate 30. The distance between the maximum outer extension of the lip 40 and the minimum extension of the lip 40 is defined as the lip squeeze. This is labeled S in FIG. 7. Lip width is the distance between the outside surface of the crown 44 and the maximum extension of the lip 40. This is labeled W in FIG. 7.

Experimentation has shown that the optimum lip width (W) is equal to the product of lip thickness (T) times hardness expressed in terms of the durometer reading (Shore A) all divided by 20. Durometer readings are known as expressions of relative hardness of elastomers as determined by a mechanical measurement process and as described typically by American Society of Testing Materials specification D22.40 (ASTM D22.40). It has also been shown that the ratio of lip squeeze (S) to drum clearance (wherein drum clearance is denoted by the letter C in FIG. 8 and is defined as the distance between the inside of the drum and the crown) should preferably be on the order of 1:3.

The seal 38 is retained in position on the plate 30 by any of a number of combinations of attachment means. One of these means is illustrated in the figures as including closed loop band 50 which is positioned between the lips 40 and 42 to retain the crown 44 of seal 38 against the transverse surface 32. A ring 52 is then bolted to the follower plate 30 and defines a support flange for the lip 40. In this manner, the seal 38 is retained between the ring 52 and the ledge 36 to prevent slipping of the lip seal 38 from the plate 30.

Figure 9:
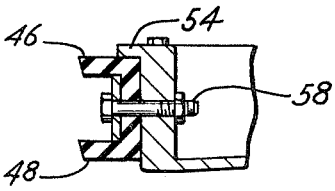
FIG. 9 is a side cross-section view of an alternate construction of the follower plate assembly.

An alternative construction is illustrated by FIG. 9. As shown in FIG. 9, a ledge 54 is defined on a plate 56. The plate 56 is formed by a stamping or drawing operation. The ledge 54 is formed on the top side of the follower plate 56, i.e., the side that would normally face the top of the barrel or container receiving the plate 56. This is in contrast with the position of ledge 36 for the embodiment of FIGS. 3–8 which is formed on the bottom side of follower plate 30.

The seal 38 for the embodiment of FIG. 9 is the same as that shown in FIGS. 3–8. The seal 38 is thus slipped on the plate 56 and retained thereon by band 50. Bolt fasteners 58 extend through band 50 and seal 38 to connect with the plate 56. Thus, the embodiment of FIG. 9 eliminates the need for a ring 52.

The embodiment of FIG. 9 is especially useful and has many advantages when it is necessary to replace a seal 38 on a plate 56. That is, the plate 56 may be raised from container 34. Bolts 58 may then be removed. The seal 38 and band 50 then slide from the plate 56. Since the seal 38 is flexible, it may be easily removed from the band 50 and a new seal 38 positioned in cooperation with the band 50. The assembly may then be reassembled by reversing the process.

It is to be understood that alternative constructions embodying the concept of the subject matter of the present invention are to be considered within the scope of the following claims. The claims are therefore to encompass the described constructions as well as equivalents thereto.

What is claimed is:

1. In a follower plate assembly for insertion into a generally cylindrical container such as an industrial drum, said container of the type having a longitudinal axis and also having discrepancies and variations in the shape and condition of the inner side wall of the container, said follower plate assembly being movable by external means along the axis of the container to follow a fluid level in the container, said assembly including a generally flat follower plate having a circumferential outline complementary with the internal outline defined by the inside container wall and also having a plate axis parallel to the longitudinal axis when the plate is in the container, the improvement comprising, in combination:

a flexible circumferential flange assembly incorporated with the plate having means for cooperative sealing engagement with the inside container wall and for also maintaining such engagement when discrepancies and variations appear therein, said flange assembly being defined on and incorporated in the circumference of the follower plate and including (a) a generally circumferential surface on the plate parallel to the plate axis and a circumferential ledge projecting radially from and unitarily with one edge of the circumferential surface toward the container side wall, the other edge of the circumferential surface providing a surface for receiving a detachably securable flange having a circumferential edge projecting radially from said other edge toward the container side wall and thereby defining means for removably slidably receiving a circumferential seal member;

(b) a separate, elastomeric U-shaped seal member of generally uniform cross section with a transverse, longitudinally extending crown section having an inside and outside surface generally parallel to the axis throughout the extent of said crown section, the inside surface being positioned against the circumferential surface by being slidably positioned on the plate, said seal forming a closed loop extending circumferentially about the plate and also including two integral, radially projecting, substantially identical, spaced lips extending generally perpendicularly from the upper and lower ends of said crown section beyond the radial extent of the ledge and into engagement with the inside wall, said lips being spaced from each other to define the U-shape of the seal member and providing means for flexible circumferential engagement of the radial lips with the inside container wall to accommodate discrepancies and variations in the shape and condition of the inside container wall, one of said lips also being engaged against the ledge to prevent movement of the seal member along the plate axis; and attachment means positoned intermediate the radially projecting lips for engaging and holding the transverse crown section on the circumferential surface and for maintaining the radially projecting lips continuously positioned for sealing engagement with the inside container wall, said attachment means including a closed circumferential band member extending between the lips against substantially the entire outside surface of the crown section bounded by said lips.

2. The improved assembly of claim 1 including the additional attachment means of a circumferential ring member attached to the plate and positioned against a lip of the seal member opposite the radially projecting ledge and providing means for maintaining the seal member between the ring member and ledge.

3. The improved assembly of claim 1 wherein the radial lips extend from the transverse section a distance equal substantially to the thickness of a radial lip times its hardness wherein hardness is expressed in terms of a durometer reading (Shore A) divided by 20.

4. The improved assembly of claim 1 wherein said radial lips have an inclined face defining a point of maximum radial extension and a point of minimum radial extension to the end of the face, the distance between said extensions being defined as the lip squeeze and wherein the ratio of lip squeeze to drum clearance is 1:3, drum clearance being the distance between the transverse section and the inside container wall.

* * * * *